US009105250B2

(12) United States Patent
Schneider

(10) Patent No.: US 9,105,250 B2
(45) Date of Patent: Aug. 11, 2015

(54) COVERAGE COMPACTION

(75) Inventor: Bengt-Olaf Schneider, Yorktown Heights, NY (US)

(73) Assignee: NVIDIA CORPORATION, Santa Clara, CA (US)

( * ) Notice: Subject to any disclaimer, the term of this patent is extended or adjusted under 35 U.S.C. 154(b) by 134 days.

(21) Appl. No.: 13/566,926

(22) Filed: Aug. 3, 2012

(65) Prior Publication Data

US 2014/0035939 A1 Feb. 6, 2014

(51) Int. Cl.
*G09G 5/36* (2006.01)

(52) U.S. Cl.
CPC ..... *G09G 5/363* (2013.01); *G09G 2340/02* (2013.01); *G09G 2360/122* (2013.01)

(58) Field of Classification Search
CPC ..... G09G 2360/122; G09G 2360/12
USPC ..... 345/545, 626, 619
See application file for complete search history.

(56) References Cited

U.S. PATENT DOCUMENTS

| | | | | |
|---|---|---|---|---|
| 4,864,629 | A * | 9/1989 | Deering | 382/216 |
| 5,430,464 | A * | 7/1995 | Lumelsky | 345/555 |
| 5,500,939 | A | 3/1996 | Kurihara | |
| 5,841,447 | A | 11/1998 | Drews | |
| 5,886,701 | A * | 3/1999 | Chauvin et al. | 345/418 |
| 5,949,428 | A * | 9/1999 | Toelle et al. | 345/589 |
| 6,016,474 | A | 1/2000 | Kim et al. | |
| 6,057,855 | A | 5/2000 | Barkans | |
| 6,141,740 | A | 10/2000 | Mahalingaiah et al. | |
| 6,314,493 | B1 | 11/2001 | Luick | |
| 6,438,664 | B1 | 8/2002 | McGrath et al. | |
| 6,476,807 | B1 | 11/2002 | Duluk, Jr. et al. | |
| 6,492,991 | B1 | 12/2002 | Morein et al. | |
| 6,496,193 | B1 | 12/2002 | Surti et al. | |
| 6,545,683 | B1 | 4/2003 | Williams | |
| 6,690,381 | B1 | 2/2004 | Hussain et al. | |
| 6,750,870 | B2 | 6/2004 | Olarig | |
| 6,825,847 | B1 | 11/2004 | Molnar et al. | |
| 6,839,062 | B2 | 1/2005 | Aronson et al. | |
| 6,891,543 | B2 | 5/2005 | Wyatt | |
| 7,015,909 | B1 | 3/2006 | Morgan, III et al. | |
| 7,170,515 | B1 | 1/2007 | Zhu | |
| 7,218,291 | B2 | 5/2007 | Abdalla et al. | |
| 7,486,290 | B1 | 2/2009 | Kilgariff et al. | |
| 7,616,202 | B1 | 11/2009 | Chen et al. | |
| 7,692,659 | B1 | 4/2010 | Molnar et al. | |
| 9,002,125 | B2 | 4/2015 | Schneider et al. | |
| 2001/0038642 | A1 | 11/2001 | Alvarez, II et al. | |
| 2003/0001857 | A1 | 1/2003 | Doyle | |

(Continued)

OTHER PUBLICATIONS

Parhami, Computer Arithmetic, Oxford University Press, Jun. 2000, pp. 413-418. city by other.

(Continued)

*Primary Examiner* — Maurice L McDowell, Jr.

(57) ABSTRACT

A method for compressing graphics data, the method comprising sorting a plurality of coverage masks into an order of descending number of samples covered by the plurality of coverage masks. A first coverage mask is identified. The first coverage mask comprises a greatest number of covered samples. Additional coverage masks of the plurality of coverage masks are compacted in the order of descending number of samples covered. Compacting additional coverage masks comprises removing samples from the coverage mask that are covered by any other compacted coverage mask.

23 Claims, 8 Drawing Sheets

(56) References Cited

U.S. PATENT DOCUMENTS

| | | | | |
|---|---|---|---|---|
| 2003/0122820 | A1 | 7/2003 | Doyle | |
| 2003/0160798 | A1 | 8/2003 | Buehler | |
| 2004/0130552 | A1* | 7/2004 | Duluk et al. | 345/506 |
| 2004/0205281 | A1 | 10/2004 | Lin et al. | |
| 2005/0093873 | A1 | 5/2005 | Paltashev et al. | |
| 2005/0140682 | A1 | 6/2005 | Sumanaweera et al. | |
| 2006/0170703 | A1 | 8/2006 | Liao | |
| 2010/0074489 | A1 | 3/2010 | Bacus et al. | |
| 2010/0296747 | A1 | 11/2010 | Srinidhi | |
| 2011/0181622 | A1 | 7/2011 | Bacus et al. | |
| 2012/0183215 | A1 | 7/2012 | Van Hook et al. | |
| 2013/0021352 | A1 | 1/2013 | Wyatt et al. | |
| 2014/0105513 | A1 | 4/2014 | Bengt-Olaf Schneider | |

OTHER PUBLICATIONS gDebugger, graphicRemedy, http://www.gremedy.com, Aug. 8, 2006. cited by other.

Duca, et al., A Relational Debugging Engine for Graphics Pipeline, International Conference on Computer Graphics and Ineractive Techniques, ACM Siggraph 2005, pp. 453-463, ISSN: 0730-0301. cited by other.

* cited by examiner

204

208

| | | | |
|---|---|---|---|
| 0 | 0 | 0 | 1 |
| 2 | 0 | 0 | 1 |
| 0 | 3 | 0 | 0 |

COVERAGE COMPACTION

TECHNICAL FIELD

The present disclosure relates generally to the field of frame buffer compression methods and more specifically to the field of frame buffer tile coverage mask compression methods.

BACKGROUND

A frame buffer is a common feature in many conventional graphics processing systems. A frame buffer may comprise one or more memory buffers that are used to contain at least one complete frame of data for communication to a video display device. As illustrated in FIG. 1, an exemplary computer system 100 comprises a processor 102 operable to execute software applications 104 and a graphics processing unit 108 operable to receive graphics information from the software applications 104 and to process the video and graphics information and deliver it for display by a display device 112. As illustrated in FIG. 1, in one embodiment, a processor 102 is operable to execute software applications 104 that interact with graphics drivers 106 and deliver video and graphics information to the graphics processing unit 108 for processing. In one embodiment, an exemplary graphics processing unit 108 comprises a frame buffer 110 operable to store video and graphics data necessary for at least one complete frame of data to be displayed by the display device 112. The contents of the frame buffer 110 may also be read out by the graphics processing unit 108 and updated with current graphics/video data.

Graphics information stored in a frame buffer may be divided into tiles. Each tile comprises one or more display pixels. An exemplary tile may have a rectangular shape or a square shape. A tile may comprise a variety of different pixels quantities (e.g., 12 pixels/tile and 64 pixels/tile). FIG. 2A illustrates a portion of an exemplary frame buffer 110 divided into tiles 202. FIG. 2A illustrates a plurality of square tiles 202 defined by dashed lines representing the individual tiles 202. As also illustrated in FIG. 2A, a particular tile 204 may contain a plurality of objects 206*a*-206*d* that cover one or more pixels of the tile 204. Object #0 (206*a*) may be a background color.

An exemplary tile 202 may be covered by any number of objects 206. Note, an object is a generic term and may represent triangles, layers, z-planes, or a collection of samples with a common property (e.g., color) that overlie pixels, etc. Rather than pixels, an exemplary tile 202 may also be referred to as comprising samples. An exemplary pixel may comprise one or more samples. An exemplary pixel may also comprise a multisample that is an average of all the color samples of the pixel.

FIG. 2B illustrates additional details of the tile 204 illustrated in FIG. 2A. Tile 204 is divided into a plurality of pixels/samples 208. Hereinafter, the pixel/samples 208 will be referred to as samples 208. The exemplary tile 204 illustrated in FIG. 2B comprises 12 samples 208, however, as noted above, a tile may comprise any number of samples. FIG. 2B also illustrates which object 206*a*-206*d* is covering a particular sample 208. For example, in the top row of samples in FIG. 2B, the first three samples 208 (from left to right) are covered by object #0 (206*a*), while the fourth sample 208 is covered by object #1 (206*b*). Similarly, the middle row of four samples are covered by object #2 (206*c*), object #0 (206*a*), object #0 (206*a*), and object #1 (206*b*), respectively from left to right, while the third row of four samples are covered by object #0 (206*a*), object #3 (206*d*), object #0 (206*a*), and object #0 (206*a*), respectively from left to right. The drawings in FIGS. 2A and 2B are not drawn to scale and some details have been exaggerated for the sake of clarity. Furthermore, while FIG. 2B illustrates an exemplary four objects, any number of objects 206 may cover a tile.

As illustrated in FIGS. 2A and 2B, frame-buffer tiles 202/204 may be covered by multiple objects 206. Each of these objects 206 may have associated coverage information (e.g., coverage masks) to identify the samples 208 covered by each object 206. As illustrated in FIG. 2B and Table 1, tile coverage information may be defined using a coverage mask. As noted above, the exemplary tile 204 illustrated in FIG. 2B comprises 12 samples 208, and 4 objects 206*a*-206*d*. As illustrated in Table 1, and described in detail below, each object (Objects #0-3 (206*a*-206*d*)) will have its own coverage mask, specifying directly which samples 208 it covers.

TABLE 1

| Object | Coverage Masks |
|---|---|
| 0 | 1110\|0110\|1011 |
| 1 | 0001\|0001\|0000 |
| 2 | 0000\|1000\|0000 |
| 3 | 0000\|0000\|0100 |

Such coverage information may be immediately available and requires no decoding. However, this method is not storage-efficient, as it requires N*K bits for the required storage masks (where N equals the quantity of samples/tile and K equals the quantity of objects/tile). For example, as illustrated in FIG. 2B and Table 1, the full set of coverage masks for tile 204 in FIG. 2B will require 48 bits to store in the frame buffer 110. As illustrated in FIG. 2B and Table 1, each coverage mask for a respective object 206 requires 12 bits, resulting in a total of 48 bits required to store the coverage masks for the tile. As illustrated in FIG. 2B and Table 1, in an exemplary coverage mask for an object, when a sample is covered by the object, the bit corresponding to that sample is a logical "1." Correspondingly, a logical "0" indicates that the particular sample is not covered by the object. The exemplary coverage masks illustrated in Table 1 also comprise vertical lines (e.g., "|") that are included for the sake of clarity and to delineate each of the three rows, but are not actually part of the coverage map. In other words, the coverage mask for object #0 is 11001101011.

SUMMARY OF THE INVENTION

This present invention provides a solution to the challenges inherent in compressing display information stored in a frame buffer, particularly compressing coverage information. In a method according to one embodiment of the present invention, a method for compressing graphics data is illustrated. The method comprises sorting a plurality of coverage masks for a plurality of objects into an order of descending number of samples covered by the plurality of coverage masks. A first coverage mask is identified. The first coverage mask comprises a greatest number of covered samples. Additional coverage masks of the plurality of coverage masks are compacted in the order of descending number of samples covered. Compacting additional coverage masks comprises removing samples from the coverage mask that are covered by any of the previous coverage masks.

In a system according to one embodiment of the present invention, a system comprises a processor and a memory. The memory comprises instructions that when executed by the processor implement a method for compressing graphics data. The method comprises sorting a plurality of coverage masks for a plurality of objects into an order of descending number of samples covered by the plurality of coverage masks. A first coverage mask is identified. The first coverage mask comprises a greatest number of covered samples. Additional coverage masks of the plurality of coverage masks are compacted in the order of descending number of samples covered. Compacting additional coverage masks comprises removing samples from the coverage mask that are covered by any of the previous coverage masks.

In a method according to one embodiment of the present invention, a method for compressing graphics data comprises sorting a plurality of coverage masks for a plurality of objects into an order of descending number of samples covered by the plurality of coverage masks. The method further comprises selecting a first compression procedure when a rate of descending number of samples is above a threshold. The first compression procedure comprises compacting the plurality of coverage masks in the order of descending number of samples. Compacting a first coverage mask removes those samples from the first coverage mask that were covered by a second coverage mask that was previously compacted. The method comprises selecting a second compression procedure when the rate of descending number of samples is below the threshold. The second compression procedure comprises replacing the plurality of coverage masks with a single coverage mask that indicates which object covers each sample in the single coverage mask.

BRIEF DESCRIPTION OF THE DRAWINGS

The present invention will be better understood from the following detailed description, taken in conjunction with the accompanying drawing figures in which like reference characters designate like elements and in which.

DETAILED DESCRIPTION

Figure 1:
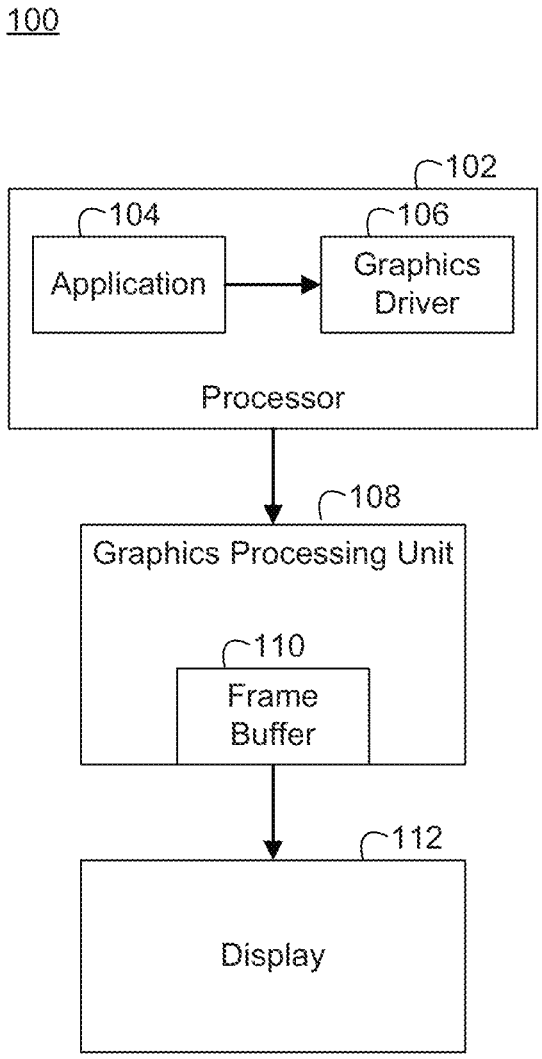
FIG. 1 illustrates an exemplary simplified block diagram of a computer system with a graphics processing unit that stores compressed graphics information in a frame buffer in accordance with the prior art.
Figures 2A, 2B:
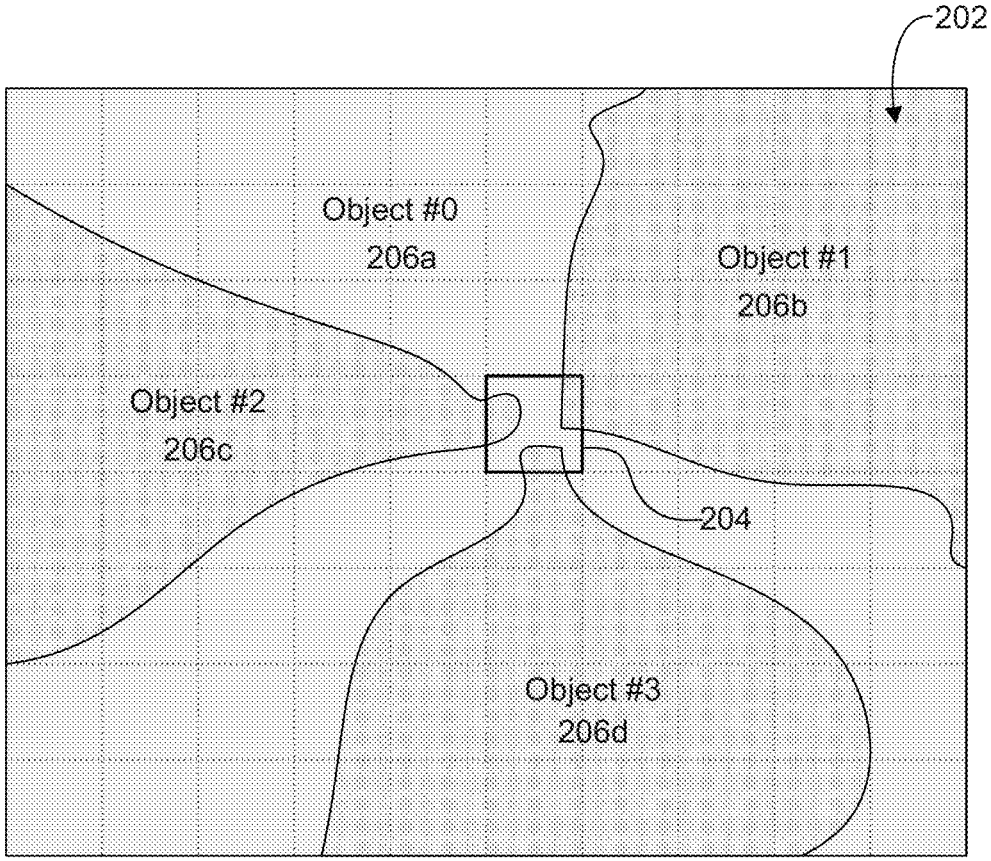
FIG. 2A illustrates an exemplary schematic illustration of a portion of a frame buffer comprising a plurality of tiles in accordance with the prior art.
FIG. 2B illustrates an exemplary schematic illustration of a tile of a frame buffer in accordance with the prior art.

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of embodiments of the present invention, numerous specific details are set forth in order to provide a thorough understanding of the present invention. However, it will be recognized by one of ordinary skill in the art that the present invention may be practiced without these specific details. In other instances, well-known methods, procedures, components, and circuits have not been described in detail so as not to unnecessarily obscure aspects of the embodiments of the present invention. The drawings showing embodiments of the invention are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the invention can be operated in any orientation.

NOTATION AND NOMENCLATURE

Some portions of the detailed descriptions, which follow, are presented in terms of procedures, steps, logic blocks, processing, and other symbolic representations of operations on data bits within a computer memory. These descriptions and representations are the means used by those skilled in the data processing arts to most effectively convey the substance of their work to others skilled in the art. A procedure, computer executed step, logic block, process, etc., is here, and generally, conceived to be a self-consistent sequence of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing" or "accessing" or "executing" or "storing" or "rendering" or the like, refer to the action and processes of a computer system, or similar electronic computing device, that manipulates and transforms data represented as physical (electronic) quantities within the computer system's registers and memories and other computer readable media into other data similarly represented as physical quantities within the computer system memories or registers or other such information storage, transmission or display devices.

When a component appears in several embodiments, the use of the same reference numeral signifies that the component is the same component as illustrated in the original embodiment.

This present invention provides a solution to the increasing challenges inherent in compressing graphics content stored in a frame buffer, in particular, the compressing of coverage information. Various embodiments of the present disclosure provide a method where a plurality of coverage masks for a plurality of objects may be compacted. As discussed in detail below, after sorting the coverage masks in a descending order of the number of samples covered, each coverage mask is compacted by removing those samples from the coverage mask that have been covered in a previously coverage mask. Therefore, only those samples not yet covered by a previously coverage mask will be included in a compacted coverage mask.

As discussed herein, graphics information (e.g., coverage mask information) stored in a frame buffer may be compressed. Compressing data stored in a frame buffer allows a required bandwidth needed for reading and writing data to and from the frame buffer to be reduced. The more that the data stored in the frame buffer can be reduced, more bits will be available for storing object information (e.g., depth and color values).

In one method of coverage mask compression, coverage information for a tile may be compressed with the use of a coverage vector that associates every sample in the tile with an object. An exemplary coverage vector may be a coverage mask that is based upon the samples, rather than objects. A coverage vector may store for each sample which object is visible. For example, if there are four objects in an exemplary tile, then 2 bits will be needed per sample to identify the visible object in the sample. With 2 bits, up to 4 objects may be identified. 5 or more objects would require additional bits (e.g., 3 bits would allow the identification of up to 8 objects). If an exemplary tile comprises 64 samples (in an exemplary 8*8 grid) with 4 objects, then 128 bits will be needed for the coverage vector map because each object will be identified with 2 bits (2*64=128).

Such a representation may use less storage as it only requires $N*[\log_2 K]$ bits, but involves a decoding step to find which samples belong to a given object. For example, the coverage information illustrated back in Table 1 may be compressed with a coverage vector such as 0001|2001|0300, where each digit is encoded with 2 bits to cover 4 objects (e.g., 00 00 00 01|10 00 00 01|00 11 00 00). However, coverage information compression using a coverage vector still may consume a significant number of bits in the compressed representation of the tile. Reducing this storage amount further would leave more bits for storing the actual object information (e.g., depth and color values).

Figure 3:
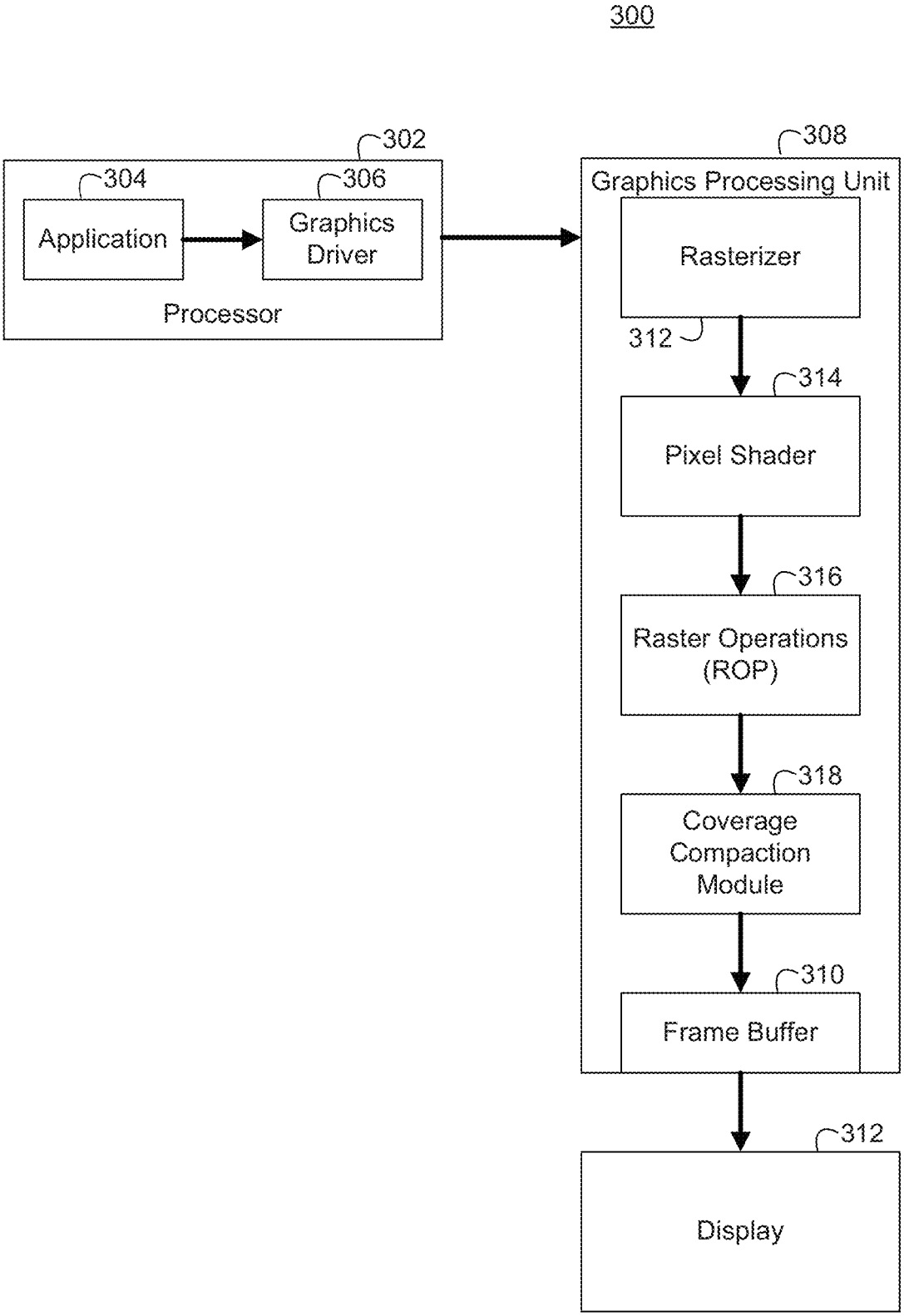
FIG. 3 illustrates an exemplary simplified block diagram of a computer system with a graphics processing unit that stores compacted coverage information in a frame buffer in accordance with an embodiment of the present invention.

FIG. 3 illustrates an exemplary computer system 300 with a graphics processing unit operable to compress coverage information for storing in a frame buffer. As illustrated in FIG. 3, computer system 300 comprises a processor 302 operable to execute software applications 304 and a graphics processing unit 308 operable to receive scene information from the software applications 304 and to process the scene information and deliver it for display by a display device 312. As illustrated in FIG. 3, in one embodiment, a processor 302 is operable to execute software applications 304 that interact with graphics drivers 306 and deliver graphics information to the graphics processing unit 308 for processing. In one embodiment, an exemplary graphics processing unit 308 comprises a frame buffer 310 operable to store graphics data necessary for at least one complete frame of data which may be displayed by the display device 312, or read-out by the graphics processing unit 308 to compare to a newer next frame of graphics data.

As also illustrated in FIG. 3, an exemplary graphics processing unit 308 comprises a rasterizer 312, a pixel shader 314, raster operations (ROP) 316, and a coverage compaction module 318. A coverage mask may be initially generated by the rasterizer 312, which may determine which samples or pixels are covered by a primitive (typically a triangle). An exemplary coverage mask defines which samples are valid within a collection of screen samples, e.g., a tile. From there, this coverage mask and associated fragments (also known as objects, herein) travel down a graphics pipeline. Along the way, the coverage mask may be reduced by the pixel shader 314 (that is, samples may be removed). Eventually, the coverage mask will arrive at raster operations (ROP) 316. In ROP 316 the coverage mask may be further reduced after various tests have been performed (e.g., alpha, clipping, depth-bounds, stencil, and depth). A final coverage mask may therefore state which samples are now currently visible or which samples are covered by which objects. Those samples and their associated display information may then be updated in the frame buffer 310. As discussed herein, the display information stored in the frame buffer 310 may be accessed for further processing by the graphics processing unit 308 or for display by the display device 312.

In one exemplary embodiment, when the display information is stored in the frame buffer 310, the display information (e.g., color, z data, and coverage) may also be compressed. In one exemplary embodiment, coverage information ready to be stored in the frame buffer 312 is compressed before storing in the frame buffer 312. Such compression methods may store information for multiple objects, where each object covers a subset of samples contained in the tile. Note, that an object, as described herein, is a generic term and may actually refer to triangles, z-planes, or a collection of samples with a common property such as color (e.g., a background). As described herein, an object's coverage mask defines which samples are covered by the object. Minimizing the number of bits required to store a coverage mask (e.g. through compression techniques) has an advantage in that it may leave more bits available to encode the objects. Using fewer bits for storing coverage information may leave more bits available for storing sample/pixel information.

As illustrated below in Table 2, a plurality of exemplary compacted coverage masks will vary according to the number of samples included in the individual compacted coverage masks. As illustrated in Table 2, and discussed herein, an identified first coverage mask is not compressed. In other words, a compacted coverage for the first coverage mask (identified as Object[0]) is identical to the first coverage mask. As illustrated in Table 2, the first coverage mask for a tile comprising 12 samples will comprise 12 bits. Thereafter, each additional coverage mask will be compacted such that each successive compacted coverage mask will only contain those samples that remain. As illustrated in Table 2, because the identified first coverage mask (Object[0]) covered 8 of the available samples, only 4 samples remain for the second compacted coverage mask (the second compacted coverage map will comprise 4 bits). As illustrated in Table 2, once a sample is covered by an object, it will not be included in subsequent compacted coverage masks.

TABLE 2

| Object | Coverage Masks | Compacted Coverage | Samples not covered |
|---|---|---|---|
| 0 | 1110\|0110\|1011 | 1110\|0110\|1011 [12] | 4 |
| 1 | 0001\|0001\|0000 | 1010 [4] | 2 |
| 2 | 0000\|1000\|0000 | 10 [2] | 1 |
| 3 | 0000\|0000\|0100 | 1 [1] | 0 |

Coverage Compaction:

In one exemplary embodiment, coverage compaction begins by looking at each of the objects and arranging them in a descending order of samples covered. Once the objects and their corresponding coverage masks are ordered, a coverage mask of the object with the highest quantity of covered samples is saved into the frame buffer (e.g., as illustrated in Table 2, an exemplary first object comprises 8 covered samples). An identified first coverage mask is not compressed, but is saved directly uncompressed. Now compacted coverage masks can be created for any additional objects in the plurality of ordered objects. As illustrated in Table 2, those samples that were covered in the first coverage mask will not be included in the compacted second coverage mask. Therefore, because 8 of the 12 exemplary samples were covered by the first coverage mask for the first object (object[0]), the compacted second coverage mask for the second object (object[1]) will comprise only 4 samples, as illustrated in Table 2. This compacted second coverage mask for the second object is therefore a map of only the remaining samples (those samples that were "0" in the previous coverage mask(s)). This compacted second coverage mask is also stored in the frame buffer. As illustrated in Table 2, when a compacted third coverage mask for a third object is created, the samples that were covered in the previous two compacted coverage masks will not be included. Because a total of 10 samples were covered in the previous two compacted coverage masks, only the two remaining samples will be included in the exemplary compacted third coverage mask. As illustrated in Table 2, the compacted third coverage mask covers an additional sample. Therefore, the compacted fourth and final coverage mask for the fourth object will contain only the last remaining sample.

As discussed in detail herein, if the first few objects cover a large portion of samples, then coverage compaction may be more efficient than either a conventional coverage mask or a coverage vector. Because a majority of the samples will be covered by a first and/or second object, the remaining number of uncovered samples will be few. Therefore the number of bits needed to store the remaining coverage masks for the last remaining objects will also be few.

A Coverage Compaction Variation:

In one exemplary embodiment, when it is known how many objects will be stored (e.g., 4 objects), a final compacted coverage mask for the final object need not be stored. As illustrated in Table 2, any samples in a compacted coverage mask for the last object will be covered by the final object. In other words, the final compacted coverage mask for the last object is merely all the samples that have not yet been covered by all the previous objects (and these remaining samples are all 1's). Therefore, the prior compacted coverage masks may be used to define what samples remain. These remaining samples would be considered to be covered by the last object without the need for a compacted coverage mask. In other words, if there are 4 objects, only the first 3 coverage masks (e.g., compacted coverage masks) will be stored However, if the number of objects is unknown, a compacted coverage mask for a final object is needed. In one exemplary embodiment, a total number of objects for a tile may be determined by looking at the compacted coverage and looking for the coverage mask that has all 1's (such that all the remaining samples were covered by that object (e.g., 11111)). Such an exemplary step may be necessary if a coverage format was used that allowed for a fixed number of coverage mask (e.g., 6), but not all of the slots were filed (e.g., there were only 4 objects). The unused slots may be identified by looking at the coverage masks and identifying the coverage mask for the object that contains all 1's in its coverage mask. In other words, the last compacted coverage mask (for object 4) completes the coverage mask. There are not any remaining uncovered samples. There are no uncovered samples left to be covered by the 5th or 6th slot. In another embodiment, while there are 6 available coverage mask slots, there might be only three objects, such that a third coverage mask will comprise all 1's (e.g., 1111), indicating it is the final coverage mask for the final object in the tile.

In one exemplary embodiment, a frame buffer may also store how many objects were present in a tile. In other words, if the frame buffer indicates that there are 4 objects, then there will only need to be three compacted coverage masks for the first three objects. In another embodiment, an exemplary frame buffer may store how many compacted coverage masks are stored, so that if three compacted coverage masks are stored, a fourth compacted coverage mask for a fourth object may be determined based on the remaining uncovered samples. In one exemplary embodiment, along with the stored compacted coverage masks, a flag indicating whether a last coverage mask is stored may also be stored.

Coverage Information Compression Efficiencies:

As discussed herein, exemplary coverage information for a tile may be most efficiently compressed following exemplary coverage compaction in accordance with embodiments of the present invention, when the first few objects cover a majority of the samples of the tile. For example, coverage compaction may not be as efficient as a coverage vector, if each of the objects covering a tile cover about the same number of samples. In such a circumstance, the number of remaining samples that are not yet covered may diminish slowly, and such a tile may require a larger number of bits to store its coverage information utilizing coverage compaction. If on the other hand, the first few objects cover a majority of the samples, then the required bits for additional compacted coverage masks may diminish very quickly. Fewer bits would be needed for the remaining compacted coverage masks for the remaining objects to cover the few remaining samples.

Determining when Coverage Compaction is Most Efficient:

Table 3, below, illustrates an example of 4 objects covering a tile with 12 samples.

TABLE 3

| Object | Expanded Coverage | Compacted Coverage | Samples not covered |
|---|---|---|---|
| 0 | 1110.0110.1011 | 1110.0110.1011 [12] | 4 |
| 1 | 0001.0001.0000 | 1010 [4] | 2 |
| 2 | 0000.1000.0000 | 10 [2] | 1 |
| 3 | 0000.0000.0100 | 1 [1] | 0 |
| Total: | 48 | 19 | |

As the example demonstrates, coverage compaction may be more storage efficient than compressing with coverage vectors. Coverage compaction may be advantageous if the number of samples not covered is reduced quickly, i.e. if the first (few) objects are big and cover the majority of the samples. The worst case scenario for coverage compaction is when all objects cover the same number of samples, that is, the number of samples not covered decreases slowly. In that case, coverage compaction might not use fewer bits than using a coverage vector, as illustrated in the formula below (N: number of samples per tile, K: number of objects per tile).

$$N\left|\binom{N}{K}\right|\left|\binom{2N}{K}\right|\left|\binom{3N}{K}\right| \ldots = \sum_{i=0}^{N-1}\left(N-\frac{iN}{K}\right) = NK - \frac{N}{K}\sum_{i=0}^{N-1} t = NK - \frac{N}{K} * \frac{K(K-1)}{2} = \frac{N(K+1)}{2}$$

For comparison, a coverage vector would use N $\log_2$ K bits which is always less than N(K+1)/2 for N,K>0.

To estimate for a more average case at what point coverage compaction becomes more storage efficient than a coverage vector, it is assumed that the number of samples covered by the (sorted) objects forms a geometric series, i.e. each object (except the last) covers the same percentage $\alpha$ ($0 \le \alpha \le 1$) of the samples not yet covered. In that case the number of bits required for encoding with coverage compaction is:

$$N + N(1-\alpha) + N(1-\alpha)^2 + N(1-\alpha)^3 + \ldots = \sum_{i=0}^{N-1} N(1-\alpha)^i = N\sum_{i=0}^{N-1}(1-\alpha)^{i-1} = N\frac{(1-\alpha)^N - 1}{(1-\alpha)-1} = N\frac{1-(1-a)^N}{a}.$$

The value of a at which coverage compaction uses fewer bits than a coverage vector occurs when:

$$N[\log_2 K] = N\frac{1-(1-\alpha)^K}{\alpha} = > 1-(1-\alpha)^K - \alpha[\log_2 K] = 0.$$

While this equation may not be solved trivially for a for general values of K, the following table gives approximate values of $\alpha$>0 for K=1 . . . 8.

TABLE 4

| K | [$\log_2$K] | A |
|---|---|---|
| 1 | 0 | 0 |
| 2 | 1 | 1 |
| 3 | 2 | 0.381 |
| 4 | 2 | 0.455 |
| 5 | 3 | 0.258 |
| 6 | 3 | 0.291 |
| 7 | 3 | 0.308 |
| 8 | 3 | 0.317 |
| 9 | 4 | 0.226 |
| 10 | 4 | 0.233 |
| 11 | 4 | 0.238 |
| 12 | 4 | 0.242 |
| 13 | 4 | 0.244 |
| 14 | 4 | 0.246 |
| 15 | 4 | 0.248 |
| 16 | 4 | 0.248 |

Coverage compaction has a largest advantage if each object covers at least 30-40% (for 3 . . . 8 objects) or at least 25% (for >8 objects) of the remaining uncovered samples. Coverage compaction may also be most efficient when the number of objects is slightly larger than a power of 2. Under such circumstances, a coverage vector would not use all possible encodings for a per-sample object-ID.

In one exemplary scene, each object covering a tile covers a same percentage of available samples of the tile. For example, a first object covers 50% of the samples, while each of the following objects covers 50% of the remaining samples. In other words, the second object covers a quarter of the samples. Under these circumstances (with a geometric series), a threshold percentage may be calculated where coverage compaction will be most efficient.

Table 3 illustrates that depending on how many objects there are, there is a certain percentage threshold that needs to be met in order for compaction coverage to be most efficient. If there are more than a power of 2 number of objects in the tile, that is 9 or 5 (which is just one larger than the power of two), then the percentage that each object needs to cover is relatively small, because an additional bit would be needed to encode object IDs for a coverage vector. For example, if there are 5 objects, then at least 3 bits will be needed to store a coverage ID for a coverage vector. However, such an arrangement will be inefficient, because while up to 8 objects could be stored with a 3-bit ID, a lesser number of objects may also be stored. This means that a coverage vector may become less efficient when storing more coverage masks. Therefore, there may be even more leeway for the use of compacted coverage under those circumstances when a coverage vector would be more inefficient.

Figure 4:
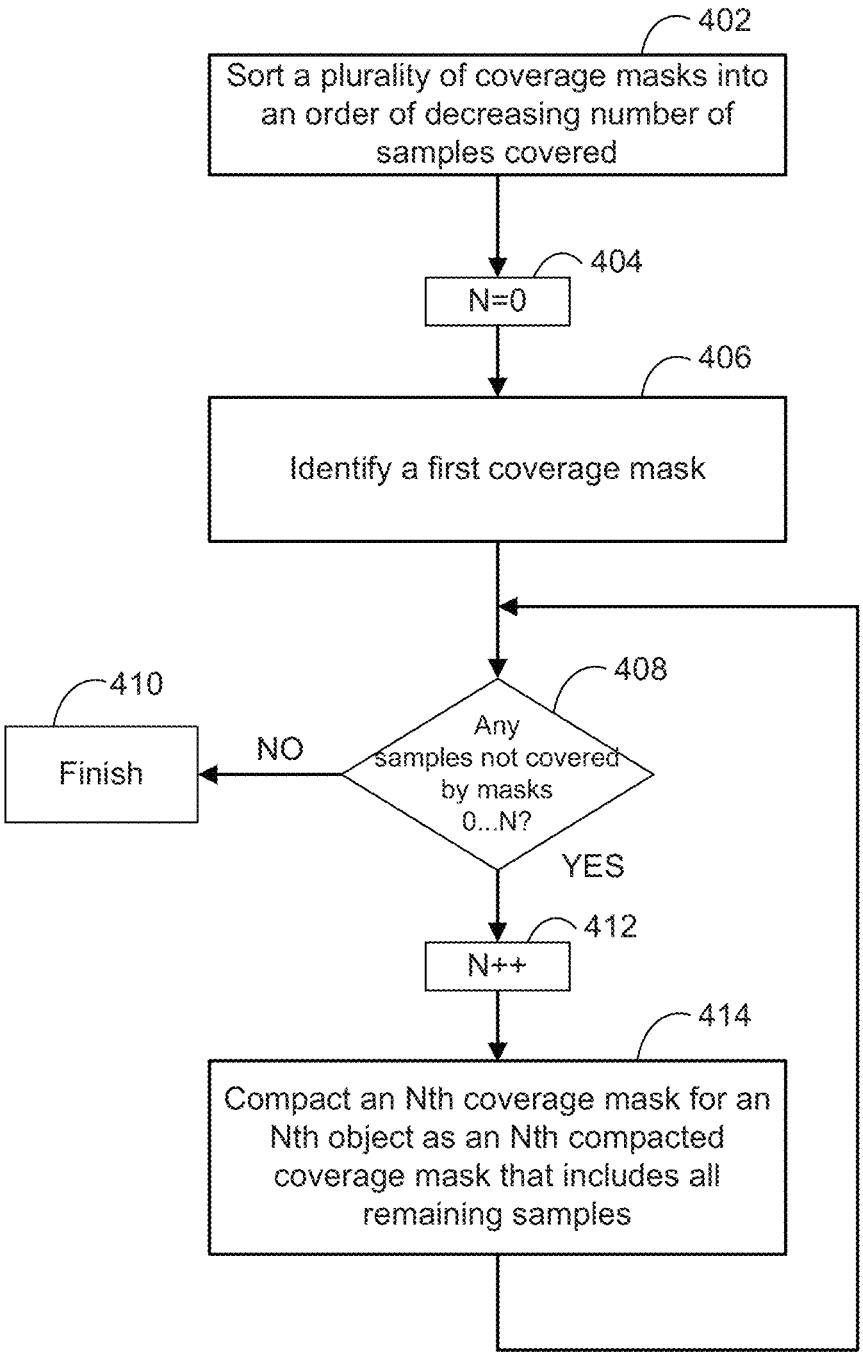
FIG. 4 illustrates an exemplary flow diagram, illustrating steps to a method for packing a frame buffer tile coverage map in accordance with an embodiment of the present invention.

FIG. 4 illustrates an exemplary flow diagram illustrating the steps to a method for compacting tile coverage information into a frame buffer. In step 402 a plurality of coverage masks for a plurality of objects are sorted into an order of decreasing number of samples covered. In one exemplary embodiment, there are four objects and therefore, four exemplary coverage masks to be sorted and compacted.

In step 404 of FIG. 4, a counter is reset to 0. By resetting the counter to 0, the coverage compaction module is ready to compact a first coverage mask. In step 406 of FIG. 4, a first coverage mask for a first object is identified. As discussed herein, the first coverage mask is a coverage mask comprising a greatest quantity of covered samples (in this example, object [0]). While this exemplary tile contains 12 samples, other exemplary tiles may contain, for example, 64 samples, as an 8*8 square of samples, requiring 64 bits of coverage information for the first coverage mask. As discussed herein, the first coverage mask may be directly saved into a frame buffer without any compression.

In step 408 of FIG. 4, the coverage compaction module determines if there are still any uncovered samples remaining that weren't covered by any previously considered coverage masks. If there are still uncovered samples, then there is still at least one additional coverage mask to be compacted for the at least one additional object. If there are no more uncovered samples, then the method continues to step 410 and the method ends. If there are more uncovered samples, then the method continues to step 412. There are no uncovered samples if the most recent compacted coverage mask contains all "1's" (e.g., 1111).

In step 412 of FIG. 4, the count N is incremented (e.g., incremented from 0 to 1). In step 414 of FIG. 4, an Nth coverage mask for an Nth object is compacted. As discussed herein, the Nth compacted coverage mask contains only those samples that remained uncovered. In other words, if all previous compacted coverage masks covered all but 4 of the samples, then the current compacted coverage mask will only contain those 4 samples and will be only 4 bits in size. After compacting the coverage mask for the Nth object, the method continues back to step 408 to determine if there are any remaining samples uncovered. In one exemplary embodiment, upon finishing the coverage compaction, the compacted coverage masks may be stored in a frame buffer. As discussed herein, each additional coverage mask will be compacted and contains consecutively fewer samples. However, there is one exception: a very last compacted coverage mask may have the same number of samples as a previous compacted coverage mask.

Figure 5:
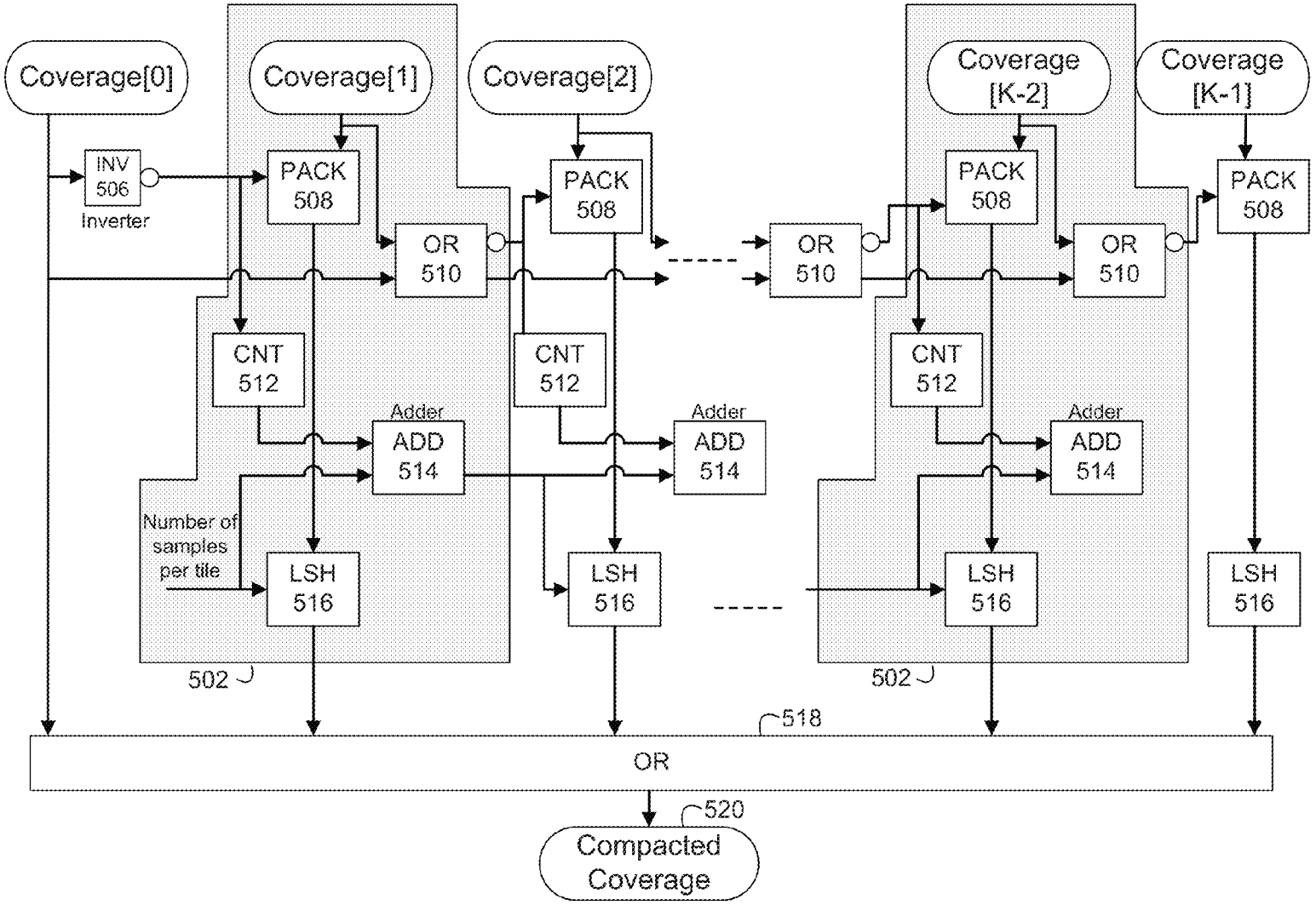
FIG. 5 illustrates an exemplary simplified block diagram of an apparatus for compacting a frame buffer tile coverage map in accordance with an embodiment of the present invention.

FIG. 5 illustrates a simplified block diagram for compacting coverage information. In one exemplary embodiment, a compactor may be built from a plurality of slices 502, as illustrated in FIG. 5. Except for a first for Coverage[0], and a last for Coverage[K−1], the slices 502 are identical. As illustrated in FIG. 5 and discussed herein, a slice performs two operations. An exemplary slice 502 compacts a coverage mask (Coverage[i]) at the top by removing all bits that were covered by previous coverage masks. The bits may be removed through the use of a cumulative mask for coverage masks [0 . . . i−1]. An inverse of this mask identifies the samples that were not covered by any previous coverage masks and selects the relevant bits in a current coverage mask. Those selected bits are then PACKed 508 into a compacted coverage mask. For subsequent stages, the compacted coverage mask is OR'd to a cumulative mask. A compacted coverage mask may also be concatenated with the compacted coverage masks of the previous slices 502, 504 by appending the compacted coverage mask to the left (LSH) 516. The compacted coverage mask may be appended to the left by left shifting the compacted coverage mask by the number of bits in all previous compacted coverage masks [0 . . . i−1]. For subsequent slices, slice[i] computes the number of bits in its coverage mask (CNT) 512 and ADDs 514 it to the number of bits in the total compacted coverage 520.

As illustrated in FIG. 5, compacted coverage may be produced by OR-ing a shifted and selectively packed coverage mask for each object. For object[0], the packed coverage is simply its basic, full coverage mask. For all other objects, the packed coverage is derived by using the uncovered coverage bits of all previous objects (OR) to select bits of the object's coverage mask and to pack them into a bit vector. That is, only bit positions that have been "0" so far will be included in any subsequent coverage mask. Once a bit position is "1," indicating that the corresponding sample has been covered by an object, it will not be part of a subsequent coverage mask.

As illustrated in FIG. 5, the packed coverage for object[i] is shifted to the left by a total number of bits in the compacted coverage of the previous objects [0 . . . i−1]. That amount is computed by the CNT block 512, which counts the 1-bits in the combined coverage of all previous objects.

As illustrated in FIG. 5, the coverage mask for the first object (Coverage[0]) is packed unchanged directly into the compacted coverage 520 via OR module 518. However, each of the remaining coverage masks for the remaining objects are appended to the first coverage mask Coverage[0] after going through a packing process. For example, as illustrated in FIG. 5, only those samples not covered in the previously packed coverage masks are packed into the next coverage mask. For example, if the first coverage mask (Coverage[0]) comprises 110010001111, then the compacted coverage mask for the second object will only contain 5 bits, in other words, a second compacted coverage mask of 001001100000 would be 10110. As illustrated in FIG. 5, only those bit positions in the previous compacted coverage masks that have not yet been covered will be passed through by the corresponding pack module 508.

FIG. 5 also illustrates that the bits of each subsequent compacted coverage mask will be shifted such that the coverage masks that are packed into the compacted coverage 520 are correctly positioned within the compacted coverage 520. For example, if the first coverage mask (coverage[0]) of 110010001111 is packed, then the second coverage mask (coverage[1]) of 001001100000, that has been reduced to 10110, will undergo the following bit shifting. Counting bits from the left, bit position [2] in the second coverage mask will be left shifted by 2. Bit position [3] in the second coverage mask will also be left-shifted by 2. Bit position [5] in the second coverage mask will be left-shifted by 3. Bit position [6] in the second coverage mask will also be left-shifted by 3. Lastly, bit position [7] in the second coverage mask will be left-shifted by 3. The resulting bit values of 10110 will be appended to the first coverage mask of 110010001111. In other words, the second coverage mask (coverage[1]) of 001001100000 is compacted to __ __ 10 __ 110 __ __ __ __ and bit shifted to 10110. Those bit positions indicated with a "_" are bit positions that were covered (e.g., "1's") in the previous compacted coverage mask(s).

Figure 6A:
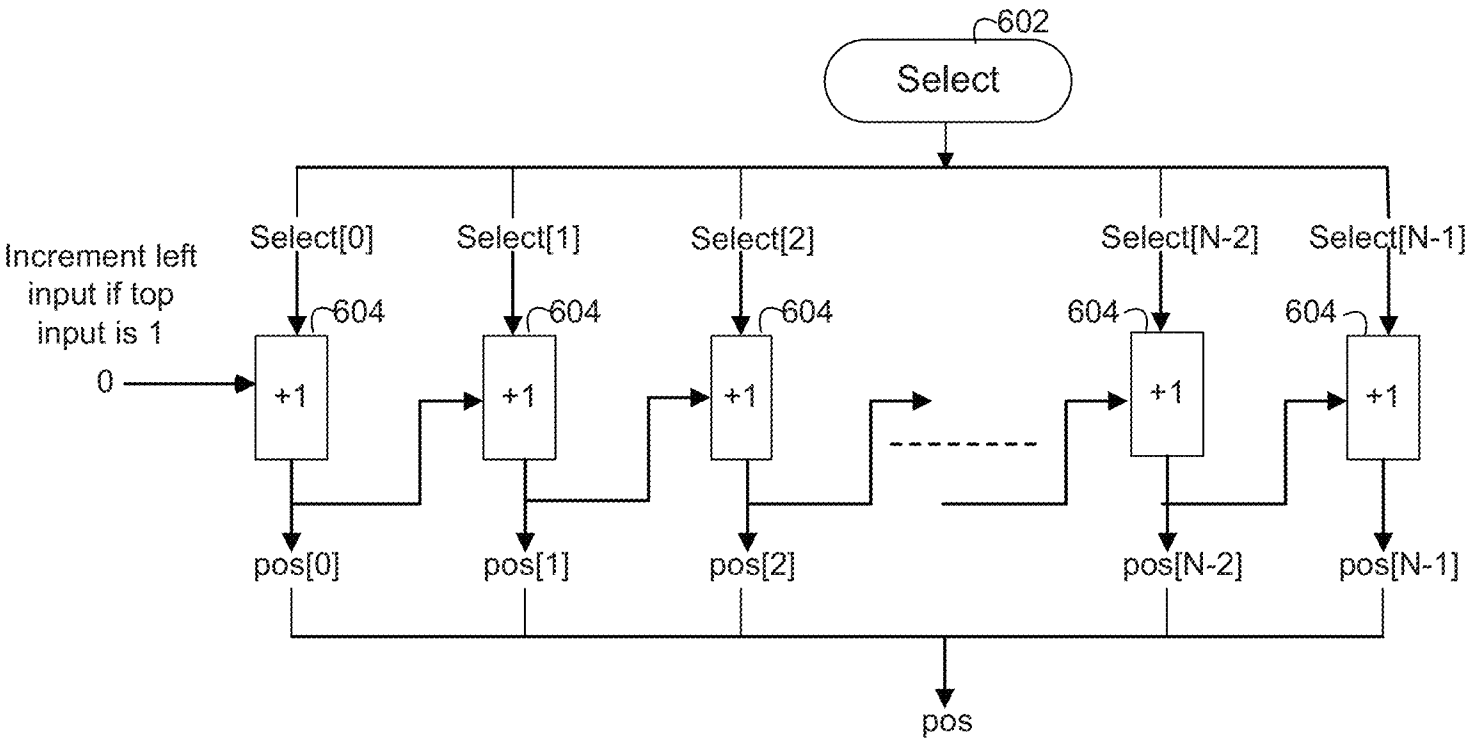
FIG. 6A illustrates an exemplary simplified block diagram of a selection circuit of a pack module for selecting coverage masks for packing into a frame buffer in accordance with an embodiment of the present invention.
Figure 6B:
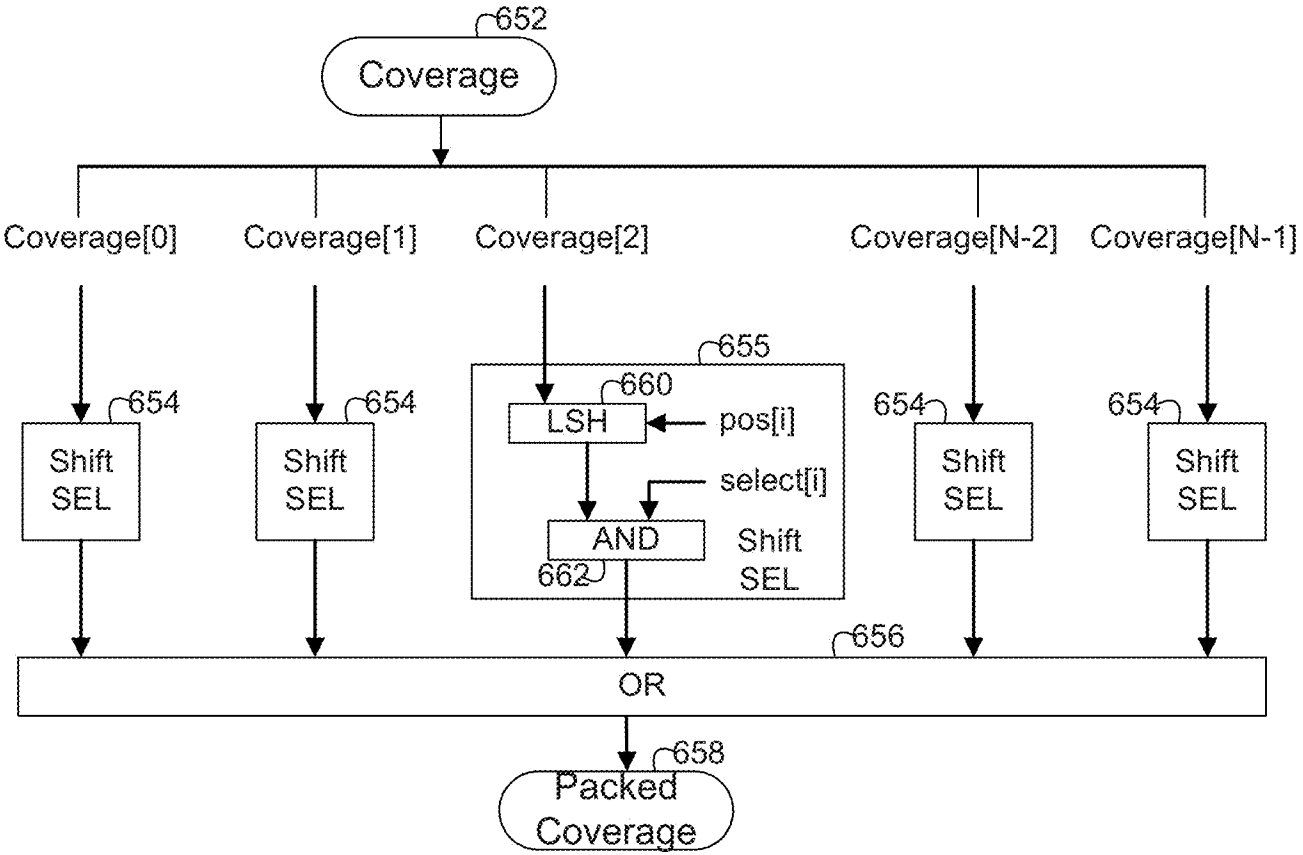
FIG. 6B illustrates an exemplary simplified block diagram of a coverage selection circuit of a pack module for selecting coverage masks for packing into a frame buffer in accordance with an embodiment of the present invention.

FIGS. 6A and 6B illustrate in more detail how to pack an object's coverage information based upon the combined coverage bits of all previous objects. FIG. 6A illustrates an exemplary selection circuit within a pack module 508 of FIG. 5, while FIG. 6B illustrates an exemplary coverage mask bit shift circuit within the pack module 508 of FIG. 5. First, a select vector 602 is used to identify the valid bit positions in the packed coverage (corresponding to samples not covered by previous objects) for each bit in the coverage 652. For those valid bits, the bit position in the packed coverage 658 is incremented for every 1-bit (by the corresponding incrementors 604) in the select vector 602. Then, these bit positions are used to properly place each selected coverage bit by shifting it to the left (by the corresponding Shift SEL modules 654, 655). Shift SEL module 655, illustrated in FIG. 6B, is a Shift SEL module 654, but with an expanded view to illustrate additional details of the Shift SEL modules 654 (e.g., LSH module 660 and AND module 662, receiving a position value (pos[i]) and a selection value (Select[i]), respectively). The shifted coverage bit is then masked by the select bit before it is OR'd 656 with the other coverage bits into the final packed coverage 658.

These exemplary diagrams are generalized for K objects/tile and N samples/tile. This is just one exemplary embodiment, and there are other ways to implement the coverage compaction methodologies that are within the scope of this present disclosure.

In one exemplary embodiment, the following algorithmic description may be used as a method for compacting a coverage vector:

```
Sort objects by number of covered samples
N= number of samples
validMask = (0x1 << N) − 1            //lower N bits set
for (k=0; k < numObjects−1; k++)      //loop over all objects but last
{
        compressedobject[k].covg = removeInvalidBits (obj[k].covg,
        validMask);
        validMask &= ~obj[k].covg
}
```

As discussed herein, coverage compaction may be most efficient when a first object covers a large proportion of the samples. A scene that includes a silhouette edge with a background that covers a large part of the tile may be stored more efficiently under compacted coverage masks rather than with a coverage vector. Coverage compaction may also be more efficient when there are skinny or narrow objects over a background or when there is a single, large first object, and then one or more smaller objects. There may also be a single bit in the frame buffer (e.g., a flag) that stores an indication of which coverage information compression method is utilized.

Figure 7:
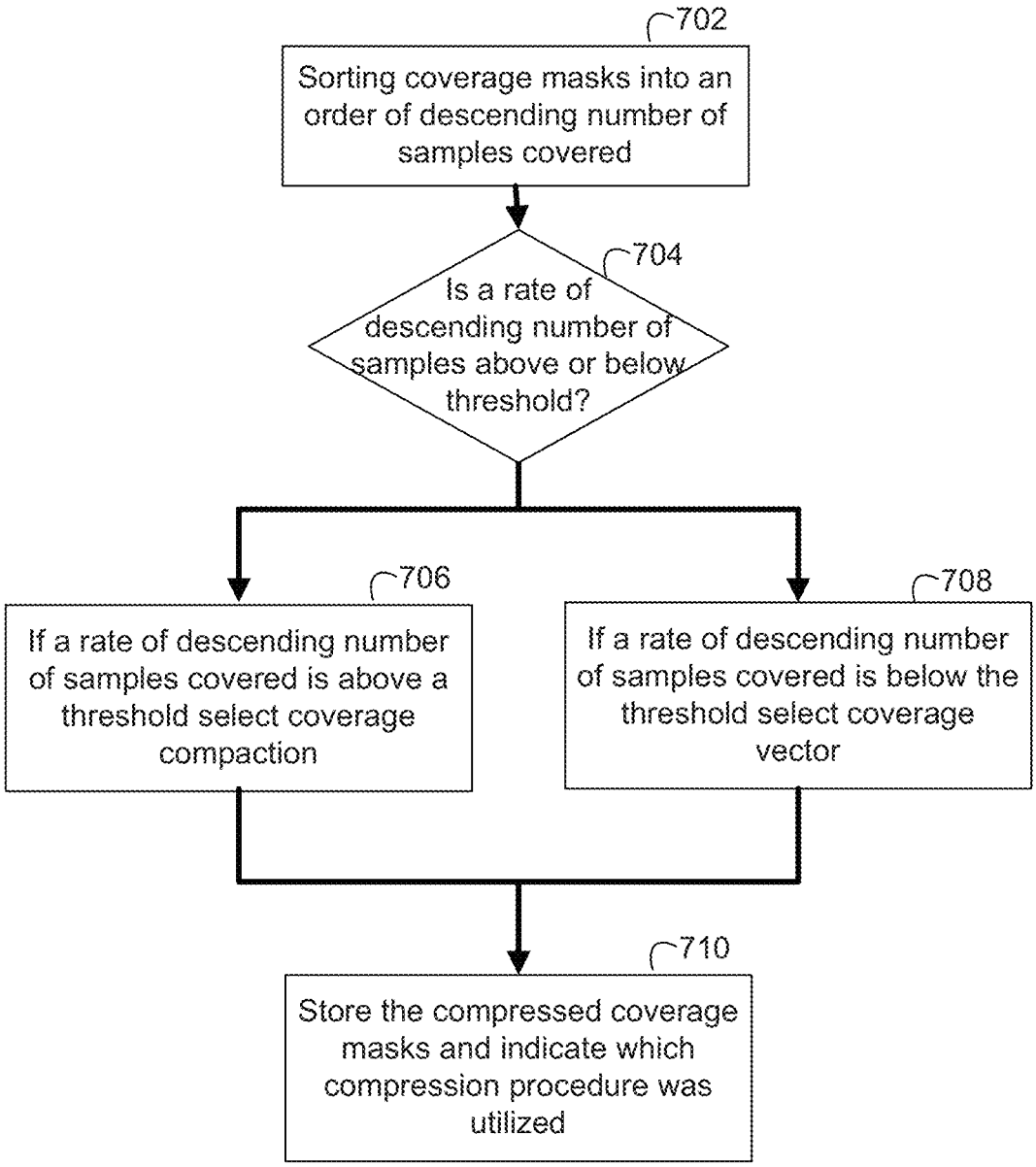
FIG. 7 illustrates an exemplary flow diagram illustrating steps to a method for selecting a coverage information compression method in accordance with an embodiment of the present invention.

FIG. 7 illustrates exemplary steps to a method for selecting one of a plurality of coverage information compression methods and indicating which compression method was selected. In step 702 of FIG. 7, coverage masks for a plurality of objects are sorted into an order of descending number of samples covered. In step 704 of FIG. 7, using the ordered coverage masks, a rate of descending number of samples is determined. In one exemplary embodiment, a percentage of covered samples for each ordered coverage mask may be determined. A higher percentage of covered samples may indicate a higher rate of descending number of covered samples.

In step 706 of FIG. 7, if a rate of descending number of samples covered is above a threshold then coverage compaction may be used. In step 708 of FIG. 7, if a rate of descending number of samples covered is below a threshold, then a coverage vector may be used. In one exemplary embodiment, if each coverage mask for an object covers at least 30-40% (for 3-8 objects) then coverage compaction may be selected. In another exemplary embodiment, if each coverage mask for an object covers at least 25% (for more than 8 objects) then coverage compaction may be selected. In another exemplary embodiment, if each coverage mask for an object covers less than 30-40% (for 3-8 objects), then a coverage vector may be used. In another exemplary embodiment, if each coverage mask for an object covers less than 25% (for more than 8 objects), then a coverage vector may be used. In step 710 of FIG. 7, compressed coverage masks are stored and an indication of which compression method was used is stored along with the compressed coverage masks.

Additional Compression Techniques:

In other embodiments, there may be other methods for compressing the coverage information. In one exemplary embodiment, the methods and algorithms discussed herein may be generalized from coverage information (triangles over samples) to associations (objects in bins). For example, with bins that are associated with general objects, the following information may be stated:

TABLE 5

| Bin | Object |
|---|---|
| 0 | 0 |
| 1 | 0 |
| 2 | 1 |
| 3 | 0 |
| 4 | 1 |
| 5 | 1 |
| 6 | 2 |
| 7 | 3 |

One exemplary method to encode this data would be with a bit vector with all the bins pointing to the objects, such as:

TABLE 6

| | Bin | | | | | | | |
|---|---|---|---|---|---|---|---|---|
| | 0 | 1 | 2 | 3 | 4 | 5 | 6 | 7 |
| Ptr | 000 | 000 | 001 | 000 | 001 | 001 | 010 | 011 |

In one exemplary embodiment, the pointer vector may have a length of 3*8=24 bits. In other words, the pointer stream may be compressed by performing a one-hot instead of a binary encoding. In one exemplary embodiment, the lower encodings were assigned to the more frequently occurring objects. So the vector may become:

TABLE 7

| | Bin | | | | | | | |
|---|---|---|---|---|---|---|---|---|
| | 0 | 1 | 2 | 3 | 4 | 5 | 6 | 7 |
| Ptr | 0001 | 0001 | 0010 | 0001 | 0010 | 0010 | 0100 | 1000 |

Written another way, the values of Table 7 may be written as:

TABLE 8

| | Bin | | | | | | | |
|---|---|---|---|---|---|---|---|---|
| | 0 | 1 | 2 | 3 | 4 | 5 | 6 | 7 |
| Ptr[0] | 1 | 1 | 0 | 1 | 0 | 0 | 0 | 0 |
| Ptr[1] | 0 | 0 | 1 | 0 | 1 | 1 | 0 | 0 |
| Ptr[2] | 0 | 0 | 0 | 0 | 0 | 0 | 1 | 0 |
| Ptr[3] | 0 | 0 | 0 | 0 | 0 | 0 | 0 | 1 |

This exemplary arrangement, illustrated in Table 8, as yet has no compression. However, this bit vector may be compressed by recognizing that as soon as a 1 is reached, the MSB 0's aren't needed. Therefore, all the LSB's may be stored together, followed by whichever LSB+1's are still need to be stored (because the 1 hasn't been hit yet). For example:

TABLE 9

| | Bin | | | | | | | |
|---|---|---|---|---|---|---|---|---|
| | 0 | 1 | 2 | 3 | 4 | 5 | 6 | 7 |
| Ptr[0] | 1 | 1 | 0 | 1 | 0 | 0 | 0 | 0 |
| Ptr[1] | — | — | 1 | — | 1 | 1 | 0 | 0 |
| Ptr[2] | — | — | — | — | — | — | 1 | 0 |
| Ptr[3] | — | — | — | — | — | — | — | 1 |

So, by concatenating the valid bits in row-order the stored bit vector from Table 9 may become (while inserting "|" between the bit indices for the sake of clarity): 11010000|11100|1011. Now the compressed pointer vector has 8+5+2+1 bits=16 bits, compressed from the original 24 bits. Such a compression may be decompressible by knowing that the length and placement of the bits in subsequent rows corresponds to the positions of "0's" in a current row.

In a further embodiment, while one encoding of Table 9 results in 11010000|11100|10|1, an alternative encoding by concatenating the valid bits in column-order can result in an encoding of: 1|1|01|01|001|0001. Such an encoding may be easier to decode as any string of zeros followed by a 1, e.g. "01", forms one bin.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A method for compressing graphics data, the method comprising:

at a graphics processor comprising integrated circuits and coupled to a display device, sorting a plurality of coverage masks into an order of descending number of samples covered by the plurality of coverage masks; and at the graphics processor, identifying a first coverage mask, wherein the first coverage mask comprises a greatest number of covered samples; and at the graphics processor, compacting additional coverage masks of the plurality of coverage masks in the order of descending number of samples covered, wherein the compacting additional coverage masks comprises removing samples from a coverage mask that are covered by any other compacted coverage mask.

2. The method of claim 1, wherein a coverage mask indicates whether a sample is covered by an object.

3. The method of claim 1, wherein a coverage mask for an object indicates whether samples contained in a tile are covered by the object.

4. The method of claim 1, wherein each additional coverage mask of the plurality of coverage masks is compacted.

5. The method of claim 1, wherein each additional coverage mask of the plurality of coverage masks is compacted, except the last coverage mask in the order of descending number of samples covered.

6. The method of claim 1, wherein a coverage mask comprises coverage information for an object that covers at least one sample in a tile.

7. The method of claim 6 further comprising storing a quantity of objects covering samples in a tile.

8. The method of claim 1 further comprising storing compacted coverage masks in a frame buffer residing in said graphics processor.

9. A system comprising:

a frame buffer; and a graphics processor implemented by integrated circuits and configured to:

sort a plurality of coverage masks into an order of descending number of samples covered by the plurality of coverage masks;

identify a first coverage mask, wherein the first coverage mask comprises a greatest number of covered samples; and compact additional coverage masks of the plurality of coverage masks in the order of descending number of samples covered by removing samples from a coverage mask that are covered by any other compacted coverage mask.

10. The system of claim 9, wherein a coverage mask indicates whether a sample is covered by an object.

11. The system of claim 9, wherein a coverage mask for an object indicates whether samples contained in a tile are covered by the object.

12. The system of claim 9, wherein each additional coverage mask of the plurality of coverage masks is compacted.

13. The system of claim 9, wherein each additional coverage mask of the plurality of coverage masks is compacted, except the last coverage mask in the order of descending number of samples covered.

14. The system of claim 9, wherein a coverage mask comprises coverage information for an object that covers at least one sample in a tile.

15. The system of claim 14, wherein the graphics processor is further configured to store a quantity of objects covering samples in a tile.

16. The system of claim 9, wherein the graphics processor is further configured to store compacted coverage masks in the frame buffer.

17. A method for compressing graphics data, the method comprising:

at a graphics processor comprising integrated circuits and coupled to a display device, selecting a compression procedure from a plurality of compression procedures, wherein a compression procedure compresses a plurality of coverage masks, and wherein the selecting a compression procedure from a plurality of compression procedures is based upon an evaluation of at least one criterion of a plurality of criteria.

18. The method of claim 17, wherein a criterion comprises an evaluation of a rate of descending number of samples covered.

19. The method of claim 18, wherein an evaluation of a rate of descending number of samples covered comprises:

sorting a plurality of coverage masks for a plurality of objects into an order of descending number of samples covered by the plurality of coverage masks;

selecting a first compression procedure when a rate of descending number of samples is above a threshold, wherein the first compression procedure comprises compacting the plurality of coverage masks in the order of descending number of samples, and wherein compacting a first coverage mask removes those samples from the first coverage mask that were covered by any other coverage mask that was previously compacted; and selecting a second compression procedure when the rate of descending number of samples is below the threshold, wherein the second compression procedure comprises replacing the plurality of coverage masks with a single coverage mask that indicates which object covers each sample in the single coverage mask.

20. The method of claim 19, wherein the rate of descending number of samples is above the threshold when each object of a plurality of objects covers at least 30 percent of the remaining uncovered samples, and wherein the plurality of objects comprises less than 9 objects.

21. The method of claim 19, wherein the rate of descending number of samples is above the threshold when each object of a plurality of objects covers at least 25 percent of the remaining uncovered samples, and wherein the plurality of objects comprises more than 9 objects.

22. The method of claim 17, wherein a criterion comprises an evaluation of a quantity of objects covering a tile.

23. The method of claim 17 further comprising storing the compressed coverage masks and storing with the compressed coverage masks an indication of which compression method has been used.

* * * * *